United States Patent [19]

Chambers

[11] 4,093,249

[45] June 6, 1978

[54] SKATE ASSEMBLY

[76] Inventor: Alan F. Chambers, 3 Gloxinia Crescent, Agincourt, Ontario, Canada

[21] Appl. No.: 752,054

[22] Filed: Dec. 20, 1976

Related U.S. Application Data

[63] Continuation-in-part of Ser. No. 700,420, Jun. 28, 1976, abandoned.

[51] Int. Cl.[2] ..... A63C 1/32; A63C 1/42

[52] U.S. Cl. ..... 280/11.12; 29/423; 264/274; 280/11.18

[58] Field of Search ..... 280/11.12, 11.17, 11.18; 29/423; 264/274

[56] References Cited

U.S. PATENT DOCUMENTS

| | | | |
|---|---|---|---|
| 1,115,790 | 11/1914 | Drevitson | 280/11.17 |
| 1,371,609 | 3/1921 | Drevitson | 280/11.17 |
| 3,212,786 | 10/1965 | Florjancic et al. | 280/11.12 |

FOREIGN PATENT DOCUMENTS

| | | | |
|---|---|---|---|
| 585,720 | 10/1959 | Canada | 280/11.12 |
| 123,068 | 8/1958 | U.S.S.R. | 280/11.12 |

*Primary Examiner*—David M. Mitchell

*Attorney, Agent, or Firm*—Rogers, Bereskin & Parr

[57] ABSTRACT

The invention provides ice skates and methods of making ice skates which have a body of a synthetic plastic material and a steel blade. The body includes an upper portion for attachment to the sole of a suitable boot and the blade has an upper portion enclosed in the body and a lower portion projecting from the body. The blade and body combine to define a localized and discrete anchor structure which locks the blade and body to one another, and the blade has a non-interfering upper surface. This surface allows the body to move freely other than at the anchor structure as the body moves longitudinally of the blade thereby limiting stress build-up in the body caused by shrinking. Mechanical fastening devices are used after shrinking to further hold the blade in the body.

16 Claims, 10 Drawing Figures

SKATE ASSEMBLY

This is a continuation-in-part of application Ser. No. 700,420 filed on June 28, 1976, now abandoned.

This invention relates to ice skates of a type which are adapted to be attached to the soles of suitable boots for use in ice hockey and similar activities.

Designers of ice skates must meet two major criteria. Firstly, the ice skate should be as light as possible so that the energy expended by a skater is kept to a minimum. This facilitates fast starts and the skater will find lighter ice skates to be less tiring to use. Secondly, the designer must ensure that ice skates have sufficient strength to withstand impacts and high side loading caused by a skater stopping or changing direction suddenly.

Traditionally, ice skates are built so as to comprise a hardened steel blade suitably secured to a metal body or frame which includes elevated toe and heel platforms secured to the underside of a boot. Quality skates made today include blades and body or frame made of steel with the blade being secured to a tubular section of the frame by spot welding.

Several difficulties exist with skates utilizing a metal blade-supporting body or frame. First, in fabricating a metal blade-supporting body to a blade it is conventional practice to use eight different steel components which are variously spot welded together. Not only is there a problem in insuring the integrity of such welds, but in welding the blade to the body there is the constant danger of weakening or reducing the temper of the hardened steel blade.

A further problem with traditional designs is that it has become increasingly more difficult to obtain consistently high quality steel for use in such blade-supporting bodies. As lesser quality steel has been used, breakage and rusting of such bodies has become more frequent.

In recent years a number of designs have been proposed which include a body of a synthetic plastic material attached during moulding to a hardened steel blade. Canadian Pat. No. 585,720 illustrates such a structure. The plastic material is moulded about a plurality of keying devices which are spaced along the length of the blade and through holes in the blade to form an integral ice skate. A further example of this type of structure is shown in Russian Pat. No 123,068. This structure includes a blade which is perforated by a series of holes spaced along its length so that the body is locked to the blade by moulding through these holes. Another example is to be found in U.S. No. 3,212,786.

An ice skate having a body of synthetic plastic material appears initially to have many advantages. The body is light and can be attached to the blade by moulding the body directly about a suitably shaped portion of the blade. Although the initial cost of the moulds is high, the subsequent manufacturing costs for large quantities would indicate that the process would be economic. However there is also a major drawback in the manufacture of such an ice skate caused by the fact that suitable plastic materials have much higher shrinkage rates than steel. Consequently if the plastic is moulded about a steel blade, the plastic material becomes highly stressed as it cools because it is locked to the steel blade and cannot skrink freely. These resulting high stresses in the plastic material often contribute to premature failure of the ice skate, and consequently the combination of a body of synthetic plastic material moulded about a steel blade in the manners shown in the forementined patents has not been an acceptable alternative for more conventional forms of ice skates.

The present invention has been made after many efforts by applicant to utilize a blade-supporting body of synthetic plastic material in a commercially feasible composite type skate. The original efforts resulted in a composite type skate having greatly improved performance characteristics. More specifically, the skates were light and more responsive to the skater's demands. However, as with skates made according to prior art teachings, a serious problem developed with respect to fracturing or cracking of the plastic body. Such cracking either began immediately after manufacture or developed within a reasonably short period of use. After considerable experiment it was discovered that while commercially available materials such as those of the polycarbonate group had more than enough inherent structural strength, the manner in which the hardened steel blade was joined to the body was critically important. In earilier designs, like those of the prior patented art, when the body is initially moulded and mechanically interlocked with the skate blade severe localized stresses are set up in the plastic material. It was further found that from these highly stressed areas cracks emanated which eventually caused the body to fail or sufficiently disrupted its appearance as to cause the user to lose confidence in its safety.

Thus, the present invention is directed to a composite skate design utilizing a blade-supporting body of synthetic plastic material joined to the skate blade in such a way as to eliminate such critical stress areas within the body thereby preventing cracking or fracturing of the body.

Hockey players who have tested skates made in accordance with the subject invention under playing conditions claim they sense more "life" or responsiveness in the blades. It is assumed that this reaction may be attributable to the greater flexibility of the assembly as compared to its all-steel counterpart.

A further advantage of the present invention is that through the use of tough synthetic plastic material such as polycarbonate, the blade-supporting body is not susceptible to denting, warping, chipping or rusting, all of which are common with a steel body.

Accordingly, the invention provides ice skates and methods of making ice skates which have a body of a synthetic plastic material and a steel blade. The body includes an upper portion for attachment to the sole of a suitable boot and the blade has an upper portion enclosed in the body and a lower portion projecting from the body. The blade and body combine to define a localised and discrete anchor structure which locks the blade and body to one another, and the blade has a non-interfering upper surface. This surface allows the body to move freely other than at the anchor structure as the body moves longitudinally of the blade thereby limiting stress build-up in the body caused by shrinking. Mechanical fastening devices are used after shrinking to further hold the blade in the body.

The invention will be better understood with reference to the following description and associated drawings, in which.

Figure 1:
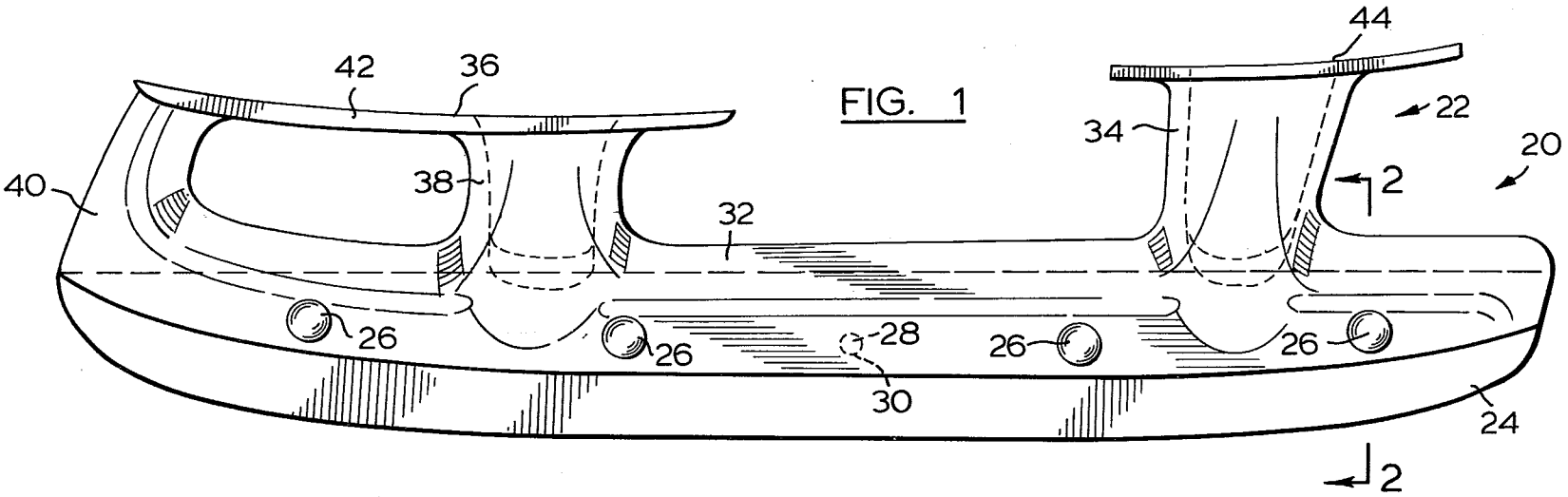
FIG. 1 is a side view of a preferred embodiment of an ice skate according to the invention.

Reference is made firstly to FIG. 1 which illustrates an ice skate 20 consisting of an upper body 22 of synthetic plastic material which is attached to a lower skate blade 24 by four rivets 26 as well as by a central anchor structure denoted generally by the numeral 28. In this, the preferred embodiment, the anchor structure 28 consists of an opening 30 formed in the blade 24 and through which the moulded body 22 extends to lock the body to the blade 24. The purpose for this structure will be described in more detail with reference to the method of manufacture.

The body 22 includes a longitudinally extending main portion 32, an upwardly extending heel support 34 and an upwardly extending front support 36. The heel support is positioned adjacent the rearward extremity of the main portion 32 and the front support includes a heavier rear upright portion 38 and a lighter front portion 40 which blends smoothly into a front extremity of the blade 24. The portions 38 and 40 blend into an enlarged flange 42 for use in attaching the ice skate to a suitable boot. Similarly, the heel support 34 includes a flange 44 for a similar purpose. Both the upright portion 38 and the heel support 34 are hollow as shown in broken outline whereas the lighter front portion 40 is solid.

The rearward extremity of the main portion 32 blends into the rear end of blade 24 without narrowing significantly to ensure that an adequate rearward-facing surface area is presented as a safety precaution to limit the possibility of injury on impact between the rear extremity of the skate and a hockey player.

Figure 2:
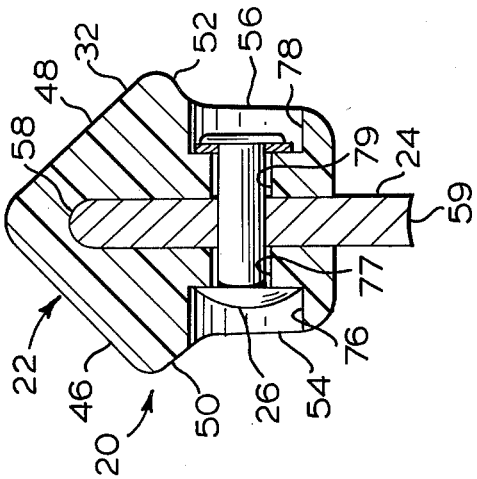
FIG. 2 is an enlarged sectional end view on line 2—2 of FIG. 1.

As better seen in FIG. 2, the main portion 32 of the body 22 is designed for optimum rigidity after assembly with the blade 24. It is evident that the cross-sectional area of the plastic body should be kept to a minimum for lightness while meeting a given strength requirement. In this embodiment the cross-section is generally diamond-shaped about the upper portion of the blade and is substantially symmetrical about a vertical plane passing through the centre of the cross-section and includes upwardly converging inclined faces 46, 48 which lie at about 90° to one another. These faces blend at their lower extremities into shorter downwardly converging faces 50, 52 which also lie at about 90° to one another and which meet respective side flanges 54, 56 positioned about the blade 24. The cross-section provides advantageous strength to weight requirements after assembly with the blade.

FIG. 2 also illustrates a rounded upper surface 58 of the blade 24. The side surfaces are substantially parallel and are formed to blend continuously at their upper extremities into the straight upper surface 58. As is conventional in better quality skates, the lower surface 59 of the blade 24 is hollow ground.

Description of the shape of the body 22 where it receives the rivets 26 will be incorporated into the description of the method of manufacture.

Figure 3:
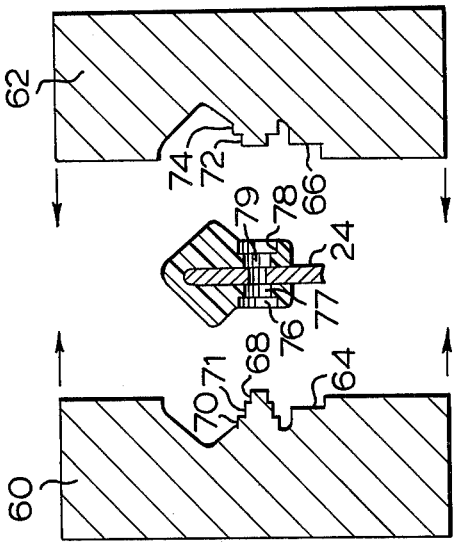
FIG. 3 is a somewhat schematic sectional view of a mould, the view being taken on a transverse plane corresponding to that indicated by line 2—2 of FIG. 1 and illustrating a preferred method of making the ice skate.

Reference is now made to FIG. 3 which illustrates a portion of a mould used in the manufacture of the ice skate shown in FIG. 1. The mould consists of respective first and second halves 60, 62 which define recesses 64, 66 for combining to define the plastic body 22 and to receive the blade 24 prior to moulding. Blade 24 is also located by two pins 68 in mould half 60 which engage in corresponding front and rear ones of the openings in the blade. Each of the pins 68 is concentric with corresponding cylindrical portions 70, 71, 72 and 74 so that after moulding, cross-sections such as that shown in FIG. 3 are provided where the front and rear ones of the rivets 26 are to be placed. Although the same structure including pin 68 could be used for the other rivet locations, the use of four pins in the mould will create tolerancing problems to ensure that all four pins meet the openings in the hardened blade. To reduce this problem only two pins are used as described. The other two rivet locations will be formed using forms in the mould halves which do not include pins 68. Instead, the portions 71, 72 will bear against the blade to block the openings in the blade so that no plastic material enters these openings. As is common practice, the portions 71, 72 can be spring-loaded outwardly for better bearing pressure on the blade surfaces.

Recesses 76, 78 and openings 77, 79 are formed in the plastic concentric with the openings in the blade for receiving the rivets as shown in FIG. 2. Also, during moulding, plastic passes through opening 30 (FIG. 1) in the blade to lock the blade in position in the body at the so-called "anchor structure". It should be noted that the ends of the opening 30 are flared or chamfered to blend the wall of the opening into the side surfaces of the blade. This blending limits sudden changes in cross-section which would otherwise cause stress build-up in the plastic.

After moulding, the body of synthetic plastic material shrinks significantly, firstly as it changes from liquid to solid and then secondly, as it cools. Consequently, if stress is to be avoided, the shrinkage must take place freely along the length of the blade. As previously described, the straight upper surface 58 of the blade 24 is rounded and this facilitates shrinkage because it has been found that if the blade is not rounded, there is a tendency for interference between the plastic body and the blade. Although this does not happen in every instance, it has been found that more consistently good results are achieved after rounding the upper surface. It will also be evident that the rounded surface 58 is desirable simply because sharp changes in cross-section are best avoided in any moulded product.

Figure 4:
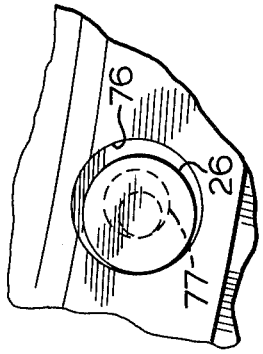
FIG. 4 is a side view of a portion of the ice skate to an enlarged scale to illustrate exemplary placement of a rivet.

The anchor structure 28 (FIG. 1) ensures that shrinkages takes place in a controlled manner. The structure 28 is located generally centrally of the length of the skate so that the body will shrink towards the centre from both ends. As a result, the recesses 76, 78 and associated openings 77, 79 (FIG. 2) for receiving the rivets 26 will no longer be concentric with the corresponding openings in the blade. For this reason, the recesses 76, 78 and openings 77, 79 are proportioned such that even with the misalignment caused by shrinkage, the rivets 26 can be engaged freely and without inteference with the sides of the recesses 76, 78. The final position of the rivet may well be such as that shown in FIG. 4 which demonstrates the position anticipated for the forward one of the rivets 26. This concept allows the blade to be first fixed securely to the body by moulding using the anchor structure, and then the rivets to be inserted to complete the assembly without creating significant stresses in the body. The final product relies on the rivets 26 for strength and these rivets are unlikely to shake loose because the blade is an extremely good fit in the plastic and because even after free shrinkage it is located positively by the anchor structure 28.

It has been found that ice skate 20 (FIG. 1) can be made to have the necessary strength while achieving the advantages of lightness offered by the use of a synthetic plastic material for the body. Suitable synthetic plastic materials include the polycarbonate group. In particular one designated by General Electric as LEXAN. However, blends of polycarbonates could also be used such as CYCOLOY (Borg-Warner) as well as any other materials such as engineered plastics provided that the necessaary strength and impact resistance are achieved. Suitable conventional fillers can also be used.

After moulding and inserting the rivets, it may be necessary to dress the finished product for excess moulding material. Otherwise the ice skate is complete and ready for attachment to a suitable boot.

The amount of shrinkage movement at each rivet opening will be substantially constant for a particular skate size and for a given plastic material. Consequently, a further improvement to the mould can be made by analysing this movement and compensating for it in the design of the mould. If complete compensation proves to be possible, the cylindrical portions 71 and 72 (FIG. 3) of the mould would then have the same diameters as the openings in the blade and the recesses 76, 78 could be just sufficiently large to receive the rivet head and end portions respectively.

Various other methods could be used for engaging the rivets (or any other equivalent fastener). For instance, with a suitable choice of blade the openings in the blade could be formed after moulding. Similarly, the recesses in the body to receive the rivet ends could also be formed after moulding.

Figure 7:
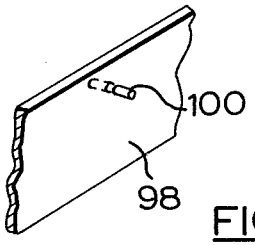
FIG. 7 is a perspective view of a portion of still another ice skate blade for use in the invention.
Figure 6:
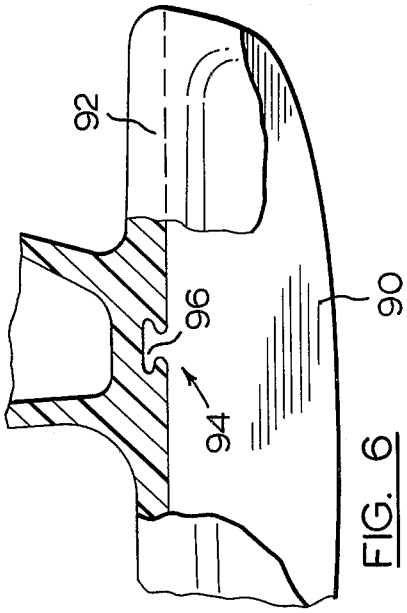
FIG. 6 is a view similar to FIG. 5 and illustrating a further embodiment of ice skate.
Figure 5:
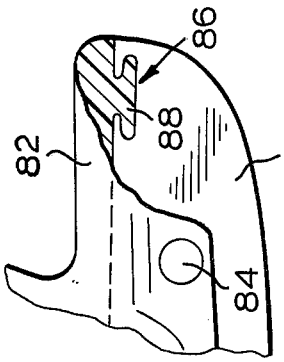
FIG. 5 is a partially sectioned side view of a rear portion of an ice skate illustrating another embodiment of the ice skate.

Reference will now be made to FIGS. 5 to 7 to describe further possible forms of the anchor structure 28 (FIG. 1). As seen in FIG. 5, a blade 80 is set in a moulded body of synthetic plastic material 82 and held in place by rivets 84. An anchor structure 86 is provided which consists of a dove-tail recess 88 in the upper surface of the blade adjacent its rearward extremity and a corresponding portion of the plastic body which is moulded into this dove-tail recess.

The longitudinal extent of the dove-tail recess 88 can be substantial from the standpoint that shrinkage within the recess will have no effect on the stresses in the body. However, the intent of the anchor structure is to provide a positive lock at a discrete portion of the blade so that there is controlled shrinkage of the body along the blade with reference to the positions of the rivets. Consequently, it is preferred that the longitudinal extent of the dove-tail recess be limited so that shrinkage of the body will take place towards this anchor structure and be of limited extent within the structure.

Although the skate shown in FIG. 5 shows the anchorstructure 86 at the rear of the skate, it can be placed anywhere along the length of the skate just as the anchor structure 28 (FIG. 1) could be placed anywhere along the length of the blade 24.

A futher embodiment of the anchor structure is shown in FIG. 6. A blade 90 is set in a moulded body 92 and a anchor structure 94 is provided. This anchor structure includes a keying projection 96 which extends upwardly from a top surface of the blade 90 and includes forward and rearward extensions which are encapsulated in the plastic body 92. Consequently, the blade 90 is trapped in the body and located longitudinally with reference to shrinkage of the body along the blade. In this instance, the longitudinal extent of the keying projection 96 should be kept to a minimum to avoid shrinkage stresses. This is because during shrinkage, the body will tend to compress the key projection longitudinally with the result that there will be inherent stresses in the body. The longer the keying projection, the greater the stresses and a point could be reached where these stresses are intolerably large. Here again the anchor structure is shown in an exemplary position relative to the length of the skate.

Yet another suitable anchor structure is illustrated in FIG. 7. In this embodiment, a blade 98 is provided with a transverse pin 100 which projects through the blade and is an interference fit in the blade. It will be evident that upon moulding the body about the blade the pin 100 is trapped in the body to therefore provide yet a further embodiment of the anchor structure originally illustrated by numeral 28 in FIG. 1.

In general, any anchor structure which retains the blade in position in the plastic body at a discrete location relative to the length of the blade will be satisfactory. The zone containing this structure will have minimal shrinkage. However, and as explained, it is essential that such a structure does not create stress difficulties and it is for this reason that the anchor structure 28 shown in FIG. 1 is to be preferred. Structure 28 is simple and effective and requires a minimum of preparation.

Figure 8:
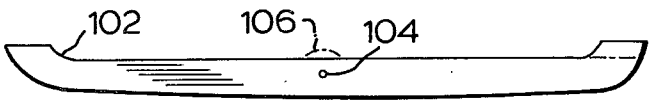
FIGS. 8 and 9 illustrate more embodiments of an ice skate blade for use in the invention.
Figure 9:
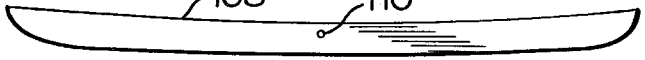

It will be evident from the description thus far that where an anchor structure is to be used, the rest of the body must be free to move longitudinally on the blade to avoid shrinkage stresses. Consequently, the blade must have a suitable form to permit this movement. Although the blade shown in FIG. 1 is to be preferred, there are other possibilities which may be desirable in certain circumstances. The term "non-interfering upper surface" will be used to describe the upper surfaces of blades which are satisfactory when used with anchor structures of the types already described. Apart from the straight upper surface shown in FIG. 1, surfaces such as those shown in FIGS. 8 and 9 are satisfactory. In FIG. 8, the upper surface includes a long depression 102 defined by forward and rearward portions which extend upwardly at the extremities of the depression. As indicated in ghost outline, the rearward upward portion (or for that matter, the forward upward portion) could be omitted. Also, an opening 104 is provided as part of an anchor structure, and if this opening causes an unacceptable reduction in cross-sectional area of the blade, the blade could be strengthened by an upward extension 106 above the opening 104. Because the longitudinal shrinkage about the anchor structure is minimal, there will be no significant stress in the body caused by the upward extension 106. Also, shrinkage of the body towards the anchor structure will not be limited by the shape of the blade. This blade therefore includes some examples of many suitable non-interfering upper surfaces.

A further suitable blade is shown in FIG. 9 which illustrates a blade having a concave upper surface 108 and an opening 110 providing part of an anchor structure as previously described.

Figure 10:
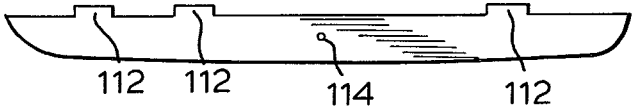
FIG. 10 illustrates a form of ice skate blade which is not acceptable in the present invention and is illustrated for comparison purposes.

In general, the upper surface of the blade will be non-interfering within the definition of the term used in this application if the plastic body is free to shrink longitudinally relative to the blade. Further in embodiments where an anchor structure is used, then the upper surface of the blade will be non-interfering within the definition if portions of the blade other than immediately adjacent the anchor structure are free to shrink longitudinally towards the anchor structure. In order to further demonstrate this concept, FIG. 10 is included to illustrate a structure which would not be acceptable. Upward projections 112 would limit longitudinal shrinkage of the body towards anchor structure 114 and therefore stresses in the body would result.

As previously illustrated with reference to the embodiments shown in FIG. 1, the upper surface of all of the blades is preferably rounded (as indicated at 58 in FIG. 2) to limit the possibility of interference between the body and the blade and also to limit local stress concentrations in the body.

Throughout the foregoing description, rivets have been used to attach the blade to the body. It will be appreciated that although such a fastener is preferred, any other suitable mechanical fastener can be used. Also, although the cross-section of the blade is shown to have parallel upright sides, the cross-section could be varied provided both that the variation did not weaken the blade significantly and provided that the body would shrink freely on the blade after moulding the body. This free shrinking is possible only on blades having no side depressions or irregularities in the manner discussed with reference to the upper surface of the blade. For convention, suitable blades will have the aforementioned non-interfering upper surface as well as non-interfering sides at least in the portion of the blade contained in the body.

The method of locating the blade during moulding can also be varied from that described above. For instance the blade can be located externally of the body in a suitably shaped fixture or by the use of only one locating pin in combination with an external support. The holes which are to receive fasteners and which do not contain a locating pin during moulding can also be blocked in many ways. For instace the holes could contain plugs of soft metal which are subsequently removed after moulding. Such variations from the preferred method are all within the scope of the invention.

What I claim:

1. An ice skate assembly comprising:

a hardened steel blade having an upper portion and a lower portion including a lower ice engaging surface terminating in upwardly curved front and rear portions, the upper portion including a non-interfering upper surface which is rounded transversely and non-interfering side surfaces;

a blade-supporting body of a synthetic plastic material located about said upper portion such that said lower portion projects outwardly from the body;

anchor structure means defined by the blade and the body and positioned at a discrete location relative to the length of the blade whereby the blade and the body are attached to one another; and fastener means passing through the body and through the upper portion of the blade at a plurality of locations along the length of the blade spaced from the anchor structure whereby the blade is further attached to the body.

2. An ice skate as claimed in claim 1 in which the upper surface is straight in the longitudinal direction.

3. An ice skate as claimed in claim 2 in which the upper surface is rounded transversely.

4. An ice skate as claimed in claim 1 in which the blade defines a transverse opening in the upper portion at said disrete position and in which the body includes a part extending through this opening to thereby define said anchor structure means.

5. An ice skate as claimed in claim 4 in which said upper surface is rounded transversely.

6. An ice skate is claimed in claim 4 in which said discrete position is substantially at the longitudinal centre of the blade.

7. An ice skate as claimed in claim 6 in which the fastener means are rivets.

8. An ice skate as claimed in claim 6 in which ends of the transverse opening are flared to blend the wall of the opening into the side surfaces of the blade.

9. An ice skate as claimed in claim 4 in which ends of the transverse opening are flared to blend the wall at the opening into the side surfaces of the blade.

10. An ice skate as claimed in claim 9 in which the body includes a generally diamond-shaped cross-section about the upper portion of the blade.

11. A method of manufacturing an ice skate of the type which is to be attached to the sole of a suitable boot, the method comprising the steps:

making an elongated steel blade by forming a lower ice engaging surface on a lower portion of the blade, forming curved front and rear end portions at respective ends of the ice engaging surface, forming a transversely rounded and non-interfering upper surface and non-interfering side surfaces on an upper portion of the blade and forming a first portion of an anchor structure;

moulding a blade-supporting body of synthetic plastic material about the upper portion while leaving the lower portion unenclosed, said moulding forming a second portion of the anchor structure such that the first and second portions are in interlocking engagement with one another to form an anchor structure at a discrete location relative to the length of the blade;

allowing the moulded body to cool whereby the body may shrink longitudinally of the blade towards the anchor structure without interference with the blade; and inserting fastener means through the assembly of the body and the blade at said upper portion at locations spaced from the anchor structure to further mechanically lock the blade and the body to one another.

12. A method of manufacturing an ice skate as claimed in claim 4 in which the blade is further formed to define a plurality of transverse openings in the upper portion, the openings being spaced longitudinally along the length of the blade, and in which the method further includes the step of temporarily blocking the transverse openings in the blade prior to moulding the body so that the fastener means is subsequently inserted through the blade at these openings after moulding and shrinking of the body.

13. A method of manufacturing an ice skate as claimed in claim 11 in which blade is formed with at least one locating opening and in which the method further includes the step of inserting a locating pin in the locating opening before moulding.

14. A method of manufacturing ice skates as claimed in claim 11 in which the skate body is moulded to define recesses and coaxial openings in the body at the locations where the fastener means are to be engaged, the recesses being adapted to receive the heads and ends of the fastener means and the openings being adapted to receive the respective bodies of the fasteners.

15. A method of manufacturing an ice skate as claimed in claim 11 in which the anchor structure is formed to define an opening in the blade having flared ends which blend the wall of the opening into the side surfaces of the blade and in which the blade supporting body is moulded such that the second portion of the anchor structure is a portion of the moulded body which is moulded into the opening.

16. A method of manufacturing an ice skate as claimed in claim 15 and further comprising the step of rounding the upper surface transversely of the blade to blend this surface into the adjacent side surfaces of the blade.

* * * * *